US005806601A

United States Patent [19]

Sundholm

[11] Patent Number: 5,806,601

[45] Date of Patent: Sep. 15, 1998

[54] DELIVERY OF FIRE-EXTINGUISHING MATERIAL BY A PRESSURE GAS SOURCE

[76] Inventor: Göran Sundholm, Ilmari Kiannon kuja 3, FIN-04310, Tuusula, Finland

[21] Appl. No.: 704,577

[22] PCT Filed: Mar. 9, 1995

[86] PCT No.: PCT/FI95/00130

§ 371 Date: Sep. 10, 1996

§ 102(e) Date: Sep. 10, 1996

[87] PCT Pub. No.: WO95/24239

PCT Pub. Date: Sep. 14, 1995

[30] Foreign Application Priority Data

Mar. 11, 1994 [FI] Finland ..... 941174

[51] Int. Cl.[6] ..... A62C 35/02

[52] U.S. Cl. ..... 169/9; 169/15; 222/464.1

[58] Field of Search ..... 169/5, 9, 14, 15; 222/399, 464.1

[56] References Cited

U.S. PATENT DOCUMENTS

| | | | |
|---|---|---|---|
| 3,199,600 | 8/1965 | Jacobs | 169/9 |
| 3,977,474 | 8/1976 | Boegli | 169/9 |
| 4,318,443 | 3/1982 | Cummins | 169/15 |
| 5,086,846 | 2/1992 | Carlson | 169/15 |
| 5,113,945 | 5/1992 | Cable | 169/15 |

FOREIGN PATENT DOCUMENTS 684055 7/1994 Switzerland .

*Primary Examiner*—Andrew C. Pike
*Attorney, Agent, or Firm*—Ladas & Parry

[57] ABSTRACT

Fire-fighting equipment has a hydraulic accumulator which contains fire-fighting liquid and a space for a pressure gas, a source of the pressure gas, a connection for connecting the pressure gas of the source to the hydraulic accumulator, and an outgoing tube from the hydraulic accumulator for discharging the fire-fighting liquid from the hydraulic accumulator for fire-fighting use. A gas inlet in the hydraulic accumulator receives the pressure gas from the connection. The tube supplies a portion of the pressure gas to the space for the pressure gas in the hydraulic accumulator. A rising tube in the hydraulic accumulator supplies the fire-fighting liquid from the hydraulic accumulator to the outgoing tube when the pressure gas is supplied to the space for the pressure gas in the hydraulic accumulator. A throttle connected to the connection mixes another portion of the pressure gas into the fire-fighting liquid supplied to the outgoing tube. A check valve in the hydraulic accumulator prevents backflow of the pressure gas from the space for the pressure gas in the hydraulic accumulator into the connection and throttle.

9 Claims, 2 Drawing Sheets

DELIVERY OF FIRE-EXTINGUISHING MATERIAL BY A PRESSURE GAS SOURCE

BACKGROUND OF THE INVENTION

The invention relates to a fire-fighting equipment, comprising a hydraulic accumulator and a pressure gas source connected thereto for delivering a mixture of liquid and gas to an outgoing tube.

Certain kinds of petrol fires, e.g., a kerosene fire in a jet engine of an aeroplane during engine test in a hangar intended for that purpose, are almost impossible to extinguish, even by means of strong fog-like liquid sprays, as is proposed, e.g., in the International Patent Application PCT/FI92/00155, publication number WO 92/20453. Such a jet engine fire is not extinguished until the whole hangar in question, which may typically have a volume of about 3000 cubic meters, has been subjected to so-called "total flooding", which means that it has been filled with a liquid fog consisting of very small drops practically entirely.

The liquid fog required can be generated in principle by means of an equipment described in the International Patent Application PCT/FI92/00317, publication number WO 93/10859. In said application, an outgoing rising pipe of a hydraulic accumulator is provided with apertures in its wall so that the drive gas of the accumulator initially drives out liquid only and the drive gas is being mixed into the outgoing liquid gradually after the liquid level has fallen to the level of the uppermost aperture in the tube wall, in increasing proportions according to the falling liquid level and more apertures in the tube wall becoming free. During final discharge stage of the accumulator, a liquid fog consisting of drops small enough for the present purpose can be achieved, but a far too large part of the liquid of the hydraulic accumulator is lost.

The gas source may be a container including nitrogen gas and having a charge pressure of e.g. about 200 bar, and it can be arranged to feed one hydraulic accumulator or a plurality of hydraulic accumulators connected in parallel.

SUMMARY OF THE INVENTION

The object of the invention is to provide a novel equipment enabling an efficient liquid delivery from one hydraulic accumulator or a plurality of hydraulic accumulators by mixing gas efficiently in the liquid immediately from the beginning and enabling the emptying of the liquid container/containers.

The present invention provides a fire-fighting equipment, comprising a hydraulic accumulator with a liquid container, having a gas space and a pressure gas source, a connection for connecting the pressure gas source T to the hydraulic accumulator, said pressure gas source being adapted to feed pressure gas to the liquid container through a gas inlet thereof and to drive liquid by pressure gas out of the hydraulic accumulator through a rising tube having a wall and arranged in the accumulator, to an outgoing tube, a throttle means in contact with the gas inlet and between the pressure gas source and the outgoing tube for mixing the gas in the outgoing tube and a check valve connected between the gas inlet and the gas space of the liquid container preventing backflow of the gas from the liquid container to the throttle means.

In a preferred embodiment of the invention, the throttle means comprises a throttled gas inlet formed in the rising tube between the gas space and the outgoing tube. In such embodiment preferably the fire-fighting equipment further comprises a throttling made in the rising tube between the gas space and the outgoing tube. Hereby, preferably, the throttling and the throttled gas inlet are preferably adapted to provide at least essentially equal pressure drops. If the gas source has a pressure of 100 bar, the respective throttlings can be dimensioned to provide a pressure drop of, e.g., 5 bar.

Due to the check valve, the gas enclosed in the accumulator continues driving out liquid by expanding, while the gas source continues delivering gas only through the throttled inlet after the throttling of the liquid tube.

In a preferred embodiment, the connection comprises a housing with the gas inlet to the accumulator, the rising tube, and a mounting part mounted in an outlet of the hydraulic accumulator, and wherein the throttling of the rising tube extends by an extent through the mounting part of the housing and the throttled gas inlet is constituted by at least one aperture in the wall of the rising tube. A ring channel between the throttling of the rising tube and the mounting part surrounding the throttling offer a simple solution to an efficient gas supply at a high pressure.

If the gas source feeds more than one hydraulic accumulator, a gas outlet to a gas inlet of an adjacent accumulator connection may preferably be provided within the extent of the throttling of the rising tube.

BRIEF DESCRIPTION OF THE DRAWINGS

In the following, the invention will be described with reference to the attached drawings in which.

DETAILED DESCRIPTION OF THE PREFERRED EMBODIMENT

Figure 1:
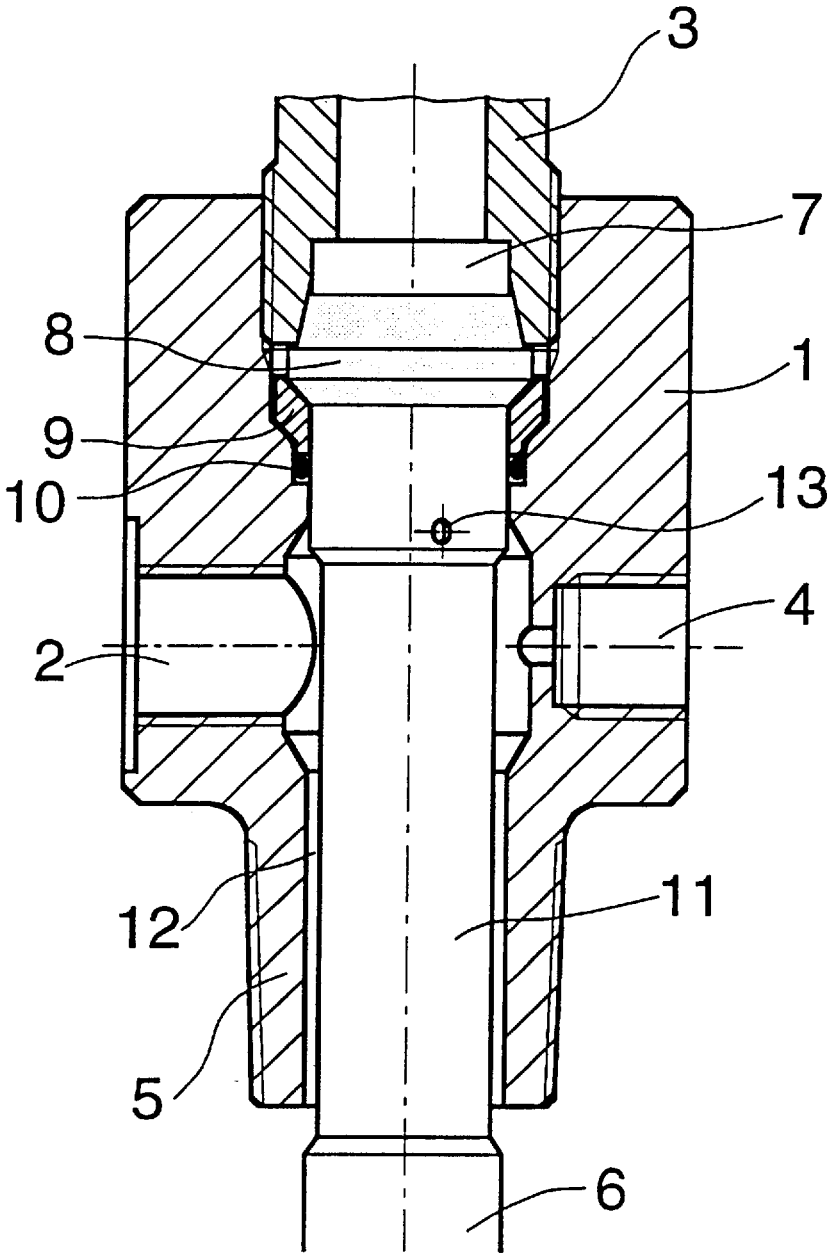
FIG. 1 shows a housing to be mounted on a hydraulic accumulator being supplied with pressurized gas from a pressure gas source.
Figure 2:
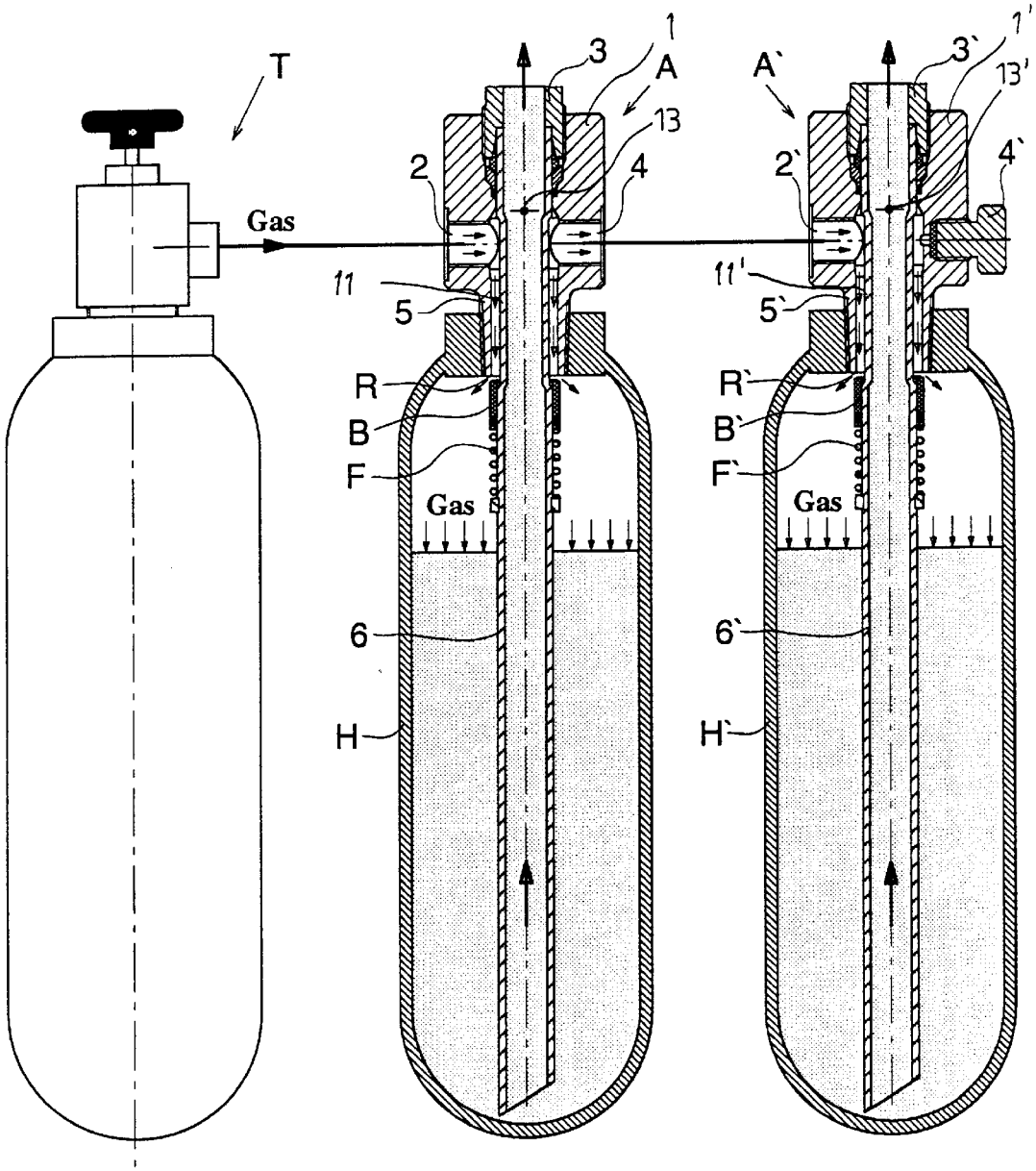
FIG. 2 shows a hydraulic accumulator of a fire-fighting equipment provided with a housing according to FIG. 1.

The embodiment shown in the FIGS. 1 and 2 contains a connection A, comprising a housing 1 provided with a gas inlet 2 for being connected to a pressure gas source T, a threaded outgoing tube 3, a hold 4 for a safety plug or alternatively a gas outlet 4 (preferably of the same form as the inlet 2) to an adjacent similar connection A' of an adjacent hydraulic accumulator H' and a mounting part 5 provided with an external thread to be mounted in the outlet of a hydraulic accumulator H. A rising tube of the hydraulic accumulator H is indicated by 6. An outlet end 7 of the tube 6 is connected to the outgoing tube 3 by means of a shear ring coupling 8. A support ring is indicated by 9 and a sealing ring arranged in connection with this is indicated by 10.

The tube 6 portion 11 extending inside the mounting part 5 of the housing 1 in front and preferably including the gas inlet 2 as well is throttled in relation to the rest of the diameter dimension of the tube 6 and indicated by 11. Thanks to the throttled tube portion 11, a pressure drop is provided, as well as a ring channel 12 between the tube portion 11 and the housing 1 from the gas inlet 2 along the mounting part 5 of the housing into a liquid container of the hydraulic accumulator H.

The ring channel 12 permits an efficient supply of drive gas to the liquid container of the hydraulic accumulator H and through that an efficient delivery of liquid into the outgoing tube 3.

At the throttling 11 is arranged a throttled gas inlet 13, which may be a suitably dimensioned aperture in the wall of the tube 6 and in direct contact with the gas inlet 2, as shown in the drawing.

The pressure drop of the outflowing liquid over the throttling 11 is preferably equal to the gas pressure drop in the throttled inlet 13, e.g., about 5 bar.

A spring-loaded F check valve B acting against the pressure of the gas flowing through the ring channel 12 is positioned around the rising tube 6 before the throttling 11, e.g., in such a way that a ring element R strives to bear against the end of the mounting part 5.

The throttled of the tube portion 11 can be performed conveniently, e.g., by means of existing clamping means for hoses of different kinds. As to the other parts, the connection according to the invention is an extremely simple construction.

The hydraulic accumulator H' connected to the gas outlet 4 of the hydraulic accumulator H comprises, corresponding to the hydraulic accumulator H, a connection A', a check valve B', a spring F', a ring element R', a housing 1', a gas inlet 2', a threaded outgoing tube 3', a hold 4', a mounting part 5', a rising tube 6', a throttled tube portion 11', and a throttled inlet 13 in the form of an aperture. Reference 4' indicates a hold.

The liquid container and other general arrangements can be of the type disclosed in International Patent Application PCT/FI93/00429, publication number WO 94/08659, and FI Patent Application 931405, FIGS. 7 to 9 thereof.

I claim:

1. A fire-fighting equipment comprising:

a hydraulic accumulator (H, H') with a liquid container, the liquid container having a gas space;

a pressure gas source (T);

a connection (A, A') connecting the pressure gas source (T) to the hydraulic accumulator (H,H') for feeding pressure gas to the liquid container through a gas inlet (2, 2') thereof and driving liquid by the pressure gas out of the hydraulic accumulator (H,H') through a rising tube (6, 6') having a wall in the accumulator to an outgoing tube (3, 3');

a throttle means (13, 13') in contact with the gas inlet and between the pressure gas source (T) and the outgoing tube (3, 3') for mixing the pressure gas and the liquid in the outgoing tube (3, 3'); and a check valve (B, B') connected between the gas inlet (2, 2') and the gas space of the liquid container for preventing backflow of the pressure gas from the liquid container to the throttle means (13, 13').

2. An equipment according to claim 1, wherein the throttle means comprises a throttled gas inlet (13) formed in the rising tube (6, 6') between the gas space and the outgoing tube (3, 3').

3. An equipment according to claim 2 further comprising a throttling (11, 11') made in the rising tube (6, 6') between the gas space and the outgoing tube (3, 3').

4. An equipment according to claim 3, wherein the connection (A, A') comprises a housing (1, 1') including the gas inlet (2, 2') to the accumulator (H, H'), the rising tube (6, 6'), and a mounting part (5) mounted in an outlet of the hydraulic accumulator, and wherein the throttling (11, 11') of the rising tube (6, 6') extends by an extent through the mounting part (5, 5') of the housing (1, 1') and the throttled gas inlet (13, 13') is constituted by at least one aperture (13, 13') in the wall of the rising tube (6, 6').

5. An equipment according to claim 4, wherein the throttling (11, 11') extends past the mounting part (5,5') into the gas space of the liquid container.

6. An equipment according to claim 5, wherein the check valve (B, B') comprises a ring element (R, R') positioned around the rising tube (6, 6') and loaded by a spring (F, F').

7. An equipment according to claim 4, wherein the housing further comprises a gas outlet (4) to a gas inlet (2') of an adjacent accumulator (H') connection (A') within the extent of the throttling (11) of the rising tube (6).

8. An equipment according to claim 3, wherein the throttling and the throttled gas inlet (13, 13') are adapted to provide at least essentially equal pressure drops.

9. In fire-fighting equipment comprising a hydraulic accumulator (H, H') containing fire-fighting liquid and a space for a pressure gas, a source (T) of the pressure gas, a connection (A, A') for connecting the pressure gas of the source (T) to the hydraulic accumulator (H, H'), and an outgoing tube (3, 3') from the hydraulic accumulator for discharging the fire-fighting liquid from the hydraulic accumulator (H, H') for fire-fighting use, the improvements comprising:

a gas inlet (2,2') in the hydraulic accumulator (H, H') for receiving the pressure gas from the connection and supplying a portion of the pressure gas to the space for the pressure gas in the hydraulic accumulator (H, H');

a rising tube (6, 6') in the hydraulic accumulator (H, H') for supplying the fire-fighting liquid from the hydraulic accumulator (H, H') to the outgoing tube (3, 3') when the pressure gas is supplied to the space for the pressure gas in the hydraulic accumulator (H, H');

a throttle (13, 13') connected to the connection (A, A') for mixing another portion of the pressure gas into the fire-fighting liquid supplied to the outgoing tube (3, 3'); and a check valve (B, B') in the hydraulic accumulator (H, H') for preventing backflow of the pressure gas from the space for the pressure gas in the hydraulic accumulator (H, H') into the connection (A, A') and the throttle (13, 13').

* * * * *